US006082070A

United States Patent [19]

Jen

[11] Patent Number: 6,082,070

[45] Date of Patent: Jul. 4, 2000

[54] EASY-TO-ASSEMBLY PATIO CONSTRUCTION

[76] Inventor: Michael T. Jen, 7901 Willow La., La Palma, Calif. 90621

[21] Appl. No.: 09/183,236

[22] Filed: Oct. 30, 1998

[51] Int. Cl.[7] ..... E04H 12/00

[52] U.S. Cl. ..... 52/650.3; 52/653.2; 52/655.1; 403/217; 403/170

[58] Field of Search ..... 52/650.3, 653.1, 52/653.2, 655.1, 126.5, 126.6, 263; 403/217, 218, 219, 170, 171, 176, 399, 398, 388, 396, 400

[56] References Cited

U.S. PATENT DOCUMENTS

| | | | |
|---|---|---|---|
| 660,246 | 10/1900 | Fessenden | 52/653.2 |
| 714,101 | 11/1902 | David | 403/400 |
| 3,792,882 | 2/1974 | Varichon | 403/217 X |
| 4,050,257 | 9/1977 | Parks et al. | 52/263 X |
| 4,516,376 | 5/1985 | King | 403/171 X |
| 4,630,550 | 12/1986 | Weitzman | 403/171 X |
| 5,193,327 | 3/1993 | Goodenberger | 52/653.2 X |
| 5,395,018 | 3/1995 | Studdiford | 403/400 X |
| 5,556,218 | 9/1996 | Homer | 403/170 |
| 5,590,974 | 1/1997 | Yang | 403/171 X |
| 5,605,410 | 2/1997 | Pantev | 403/176 X |
| 5,626,436 | 5/1997 | Dragone | 403/398 X |
| 5,878,546 | 3/1999 | Westover | 403/388 X |

FOREIGN PATENT DOCUMENTS

| | | | |
|---|---|---|---|
| 1276390 | 10/1961 | France | 403/176 |
| 617047 | 2/1961 | Italy | 403/400 |
| 1261219 | 1/1972 | United Kingdom | 403/170 |
| 1341569 | 12/1973 | United Kingdom | 403/170 |

*Primary Examiner*—Beth A. Stephan
*Assistant Examiner*—Brian E. Glessner
*Attorney, Agent, or Firm*—Raymond Y. Chan; David and Raymond

[57] ABSTRACT

A patio construction, which is easy to assemble and disassemble by the user, includes at least four base joint to respectively support four vertical construction beams extended upwardly. Four top ends of said four vertical construction beams respectively connect four triaxial construction joints adapted for connecting at least four horizontal construction beams. A plurality of ceiling bars are detachably mounted between at least two of said horizontal construction beams.

4 Claims, 7 Drawing Sheets

EASY-TO-ASSEMBLY PATIO CONSTRUCTION

FIELD OF THE PRESENT INVENTION

The present invention relates to patio, and more particularly to a patio construction which is easy to assemble without specific tools and skill so that the users may assemble or disassemble the patio by themselves.

BACKGROUND OF THE PRESENT INVENTION

Most house owners would hire carpenters or construction contractors to construct a patio in the back yard for cookout, barbecue or other outdoor activities. Although the labor and material costs for constructing a patio by the contractors are expensive, the users are unable to do-it-themselves because there is no standard patio construction component available in market.

Normally, the patio is constructed by wood beams which are permanently connected with each other in order to provide a rigid construction. In other words, the conventional wood patio is permanently attached to the house or the ground. Therefore, when the house owner moves to a new house, he or she must reconstruct a new patio.

SUMMARY OF THE PRESENT INVENTION

It is thus a first object of the present invention to provide an easy-to-assembly patio construction which comprises standard components enabling the house owner to assemble or disassemble the patio easily without the need of any specific tool or construction skill.

A further object of the present invention is to provide an easy-to-assembly patio construction which can minimize the building cost and simplify the components thereof Yet another object of the present invention is to provide an easy-to-assembly patio construction wherein the user can disassemble the patio when he or she moves out the old house and reassemble the patio at the new house.

Still another object of the present invention is to provide an easy-to-assembly patio construction which provides a firm and rigid structure.

Accordingly, in order to accomplish the above objects, the present invention provides an easy-to-assembly patio construction which comprises:

at least a first, a second, a third, and a fourth base joint, wherein each of the base joints is spacedly affixed on ground and has a supporting post extended upwardly and vertically;

at least a first, a second, a third, and a fourth vertical construction beam, wherein each of the construction beams has a top connecting end socket and a bottom connecting end socket, the four supporting posts of the four base joints are fittedly inserted into the four bottom connecting end sockets of the four vertical construction beams respectively, so as to support the four vertical construction beams to extend upwardly and vertically;

at least a first, a second, a third, and a fourth triaxial construction joint, wherein each of the triaxial construction joints comprises a central joint body, a left and a right connecting post extending form the joint body and along a x-axis of the triaxial construction joint, a bottom connecting joint extending from the joint body and along a y-axial of the triaxial construction joint, and a front and a rear connecting post extending from the joint body and along a z-axis of the triaxial construction joint, wherein the four bottom connecting posts of the four triaxial construction joints are fittedly inserted into the four top connecting end sockets of the four vertical construction beams respectively, so as to firmly support the four triaxial construction joints on top of the four vertical construction beams respectively;

at least a first, a second, a third, and a fourth horizontal construction beams, each of the horizontal construction beams having a first connecting end socket and a second connecting end socket, wherein the two right connecting posts of the first and second triaxial construction joints are fittedly inserted into the two first connecting end sockets of the first and second horizontal construction beams respectively while the two left connecting posts of the third and fourth triaxial construction joints are fittedly inserted into the two second connecting end sockets of the first and second horizontal construction beams respectively, wherein the two rear connecting posts of the first and third triaxial construction joints are fittedly inserted into the two first connecting end sockets of the third and fourth horizontal construction beams respectively while the two front connecting posts of the second and fourth triaxial construction joints are fittedly inserted into the two second connecting end sockets of the third and fourth horizontal construction beams respectively, so that the four horizontal construction beams are firmly supported and horizontally extended between the four vertical construction beams; and a plurality of ceiling bars mounted on and extended between at least two of the four horizontal construction beams.

DETAILED DESCRIPTION OF THE PREFERRED EMBODIMENT

Figure 1:
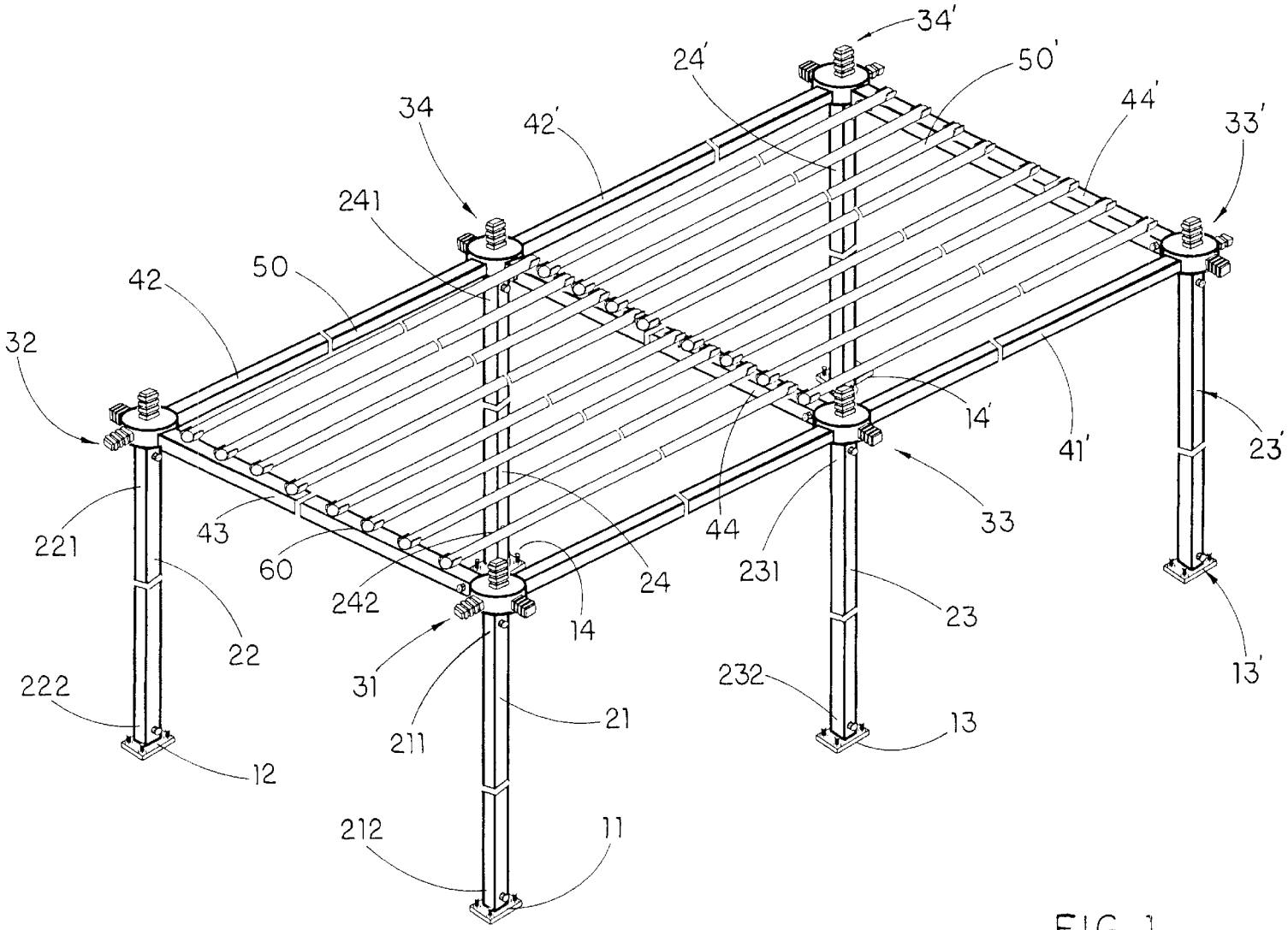
FIG. 1 is a perspective view of a patio construction in accordance with a preferred embodiment of the present invention.

Referring to FIG. 1, an easy-to-assembly patio construction according to a preferred embodiment of the present invention is illustrated, which comprises at least a first, a second, a third, and a fourth base joint, 11, 12, 13, 14, at least a first, a second, a third, and a fourth vertical construction beams 21, 22, 23, 24, at least a first, a second, a third, and a fourth triaxial construction joint 31, 32, 33, 34, at least a first, a second, a third, and a fourth horizontal construction beam 41, 42, 43, 44, and a plurality of ceiling bars 50.

Figure 2:
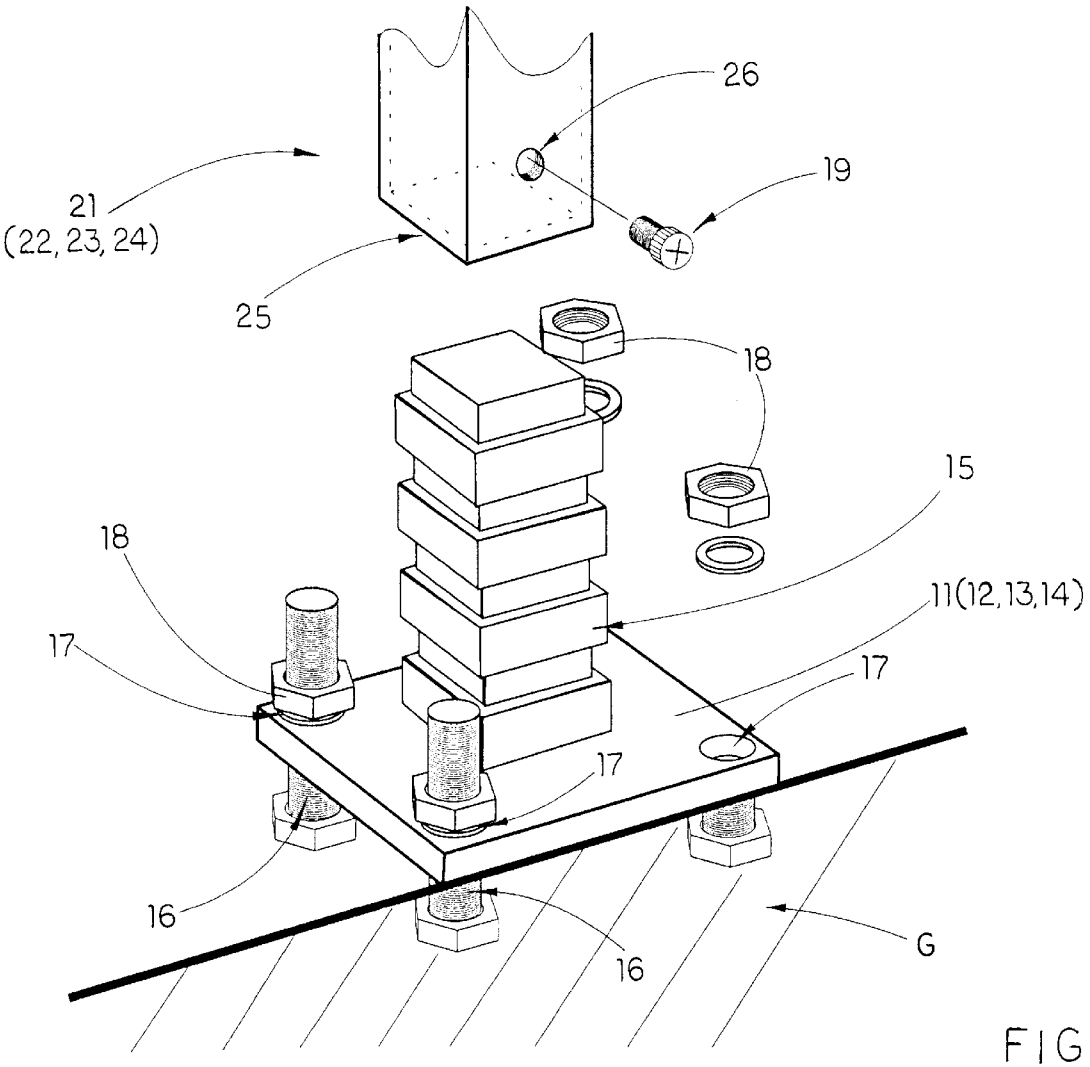
FIG. 2 is an exploded perspective view of the base joint of the patio construction according to the above preferred embodiment of the present invention.

As shown in FIGS. 1 and 2, each of the base joints 11, 12, 13, 14 is spacedly affixed on ground and has a supporting post 15 extended upwardly and vertically. In order to firmly and rigidly affix the four base joints 11, 12, 13, 14 on ground G, four bolts 16 are pre-embedded in the concrete ground G with their threaded shanks 161 upwardly extended from the ground G. Four corners of each of the base joints 11, 12, 13, 14 forms four locking holes 17 respectively, so that the each of the base joints 11, 12, 13, 14 are able to be affixed on ground G by penetrating the four threaded shanks 161 through the four locking holes 17 respectively and firmly fastening four sets of nut and washer 18 to the four threaded shanks 161 respectively.

Along the supporting post 15 of each of the base joints 11, 12, 13, 14, a predetermined number of locking grooves 151 are spacedly provided around the supporting post 15. The height of the supporting posts 15 depend on the length of the vertical construction beams 21, 22, 23, 24. According to the present embodiment, the height of the supporting post 15 should be at least 5 inches.

As shown in FIGS. 1 to 4, the four vertical construction beams 21, 22, 23, 24 each has a bottom connecting end socket 25 and a bottom connecting end socket 26. According to the present embodiment, each of the vertical construction beams 21, 22, 23, 24 is made of an aluminum (or ABS plastic) square or rectangular tube having a predetermined length at least higher than an average human height, wherein the bottom end portion and the top end portion of the elongated hole extended along the tube form the bottom and top connecting end sockets 25, 26. The size of the elongated hole of each vertical construction beams 21, 22, 23, 24 is preferred equal to the size of the supporting posts 15 of the four base joints II, 12, 13, 14.

At least a bottom locking screw hole 251 and a top locking screw hole 261 are formed on the top end and the bottom end of each of the vertical construction beams 21, 22, 23, 24 respectively. The four supporting posts 15 of the four base joints 11, 12, 13, 14 are fittedly inserted into the four bottom connecting end sockets 25 of the four vertical construction beams 21, 22, 23, 24 respectively, so as to support the four vertical construction beams 21, 22, 23, 24 to extend upwardly and vertically, as shown in FIGS. 1, 2 and 4.

Basically, the four vertical construction beams 21, 22, 23, 24 are fully supported by the four base joints 11, 12, 13, 14 respectively. However, in order to prevent the vertical construction beams 21, 22, 23, 24 from being detached accidentally, as shown in FIG. 2 and 4, four locking screws 19 are respectively screwed into the four bottom locking screw holes 251 of the four vertical construction beams 21, 22, 23, 24 until each of the four locking screws 19 is engaged in a selected locking groove 151 of the respective supporting post 15 of the respective base joint 11, 12, 13, 14. Since the base joints 11, 12, 13, 14 may be affixed on an inclined ground G, the user may select the locking groove 151 at different height to lock in the locking screw 19, so as to ensure the top of each vertical construction beams 21, 22, 23, 24 is positioned at equal height.

Figure 3:
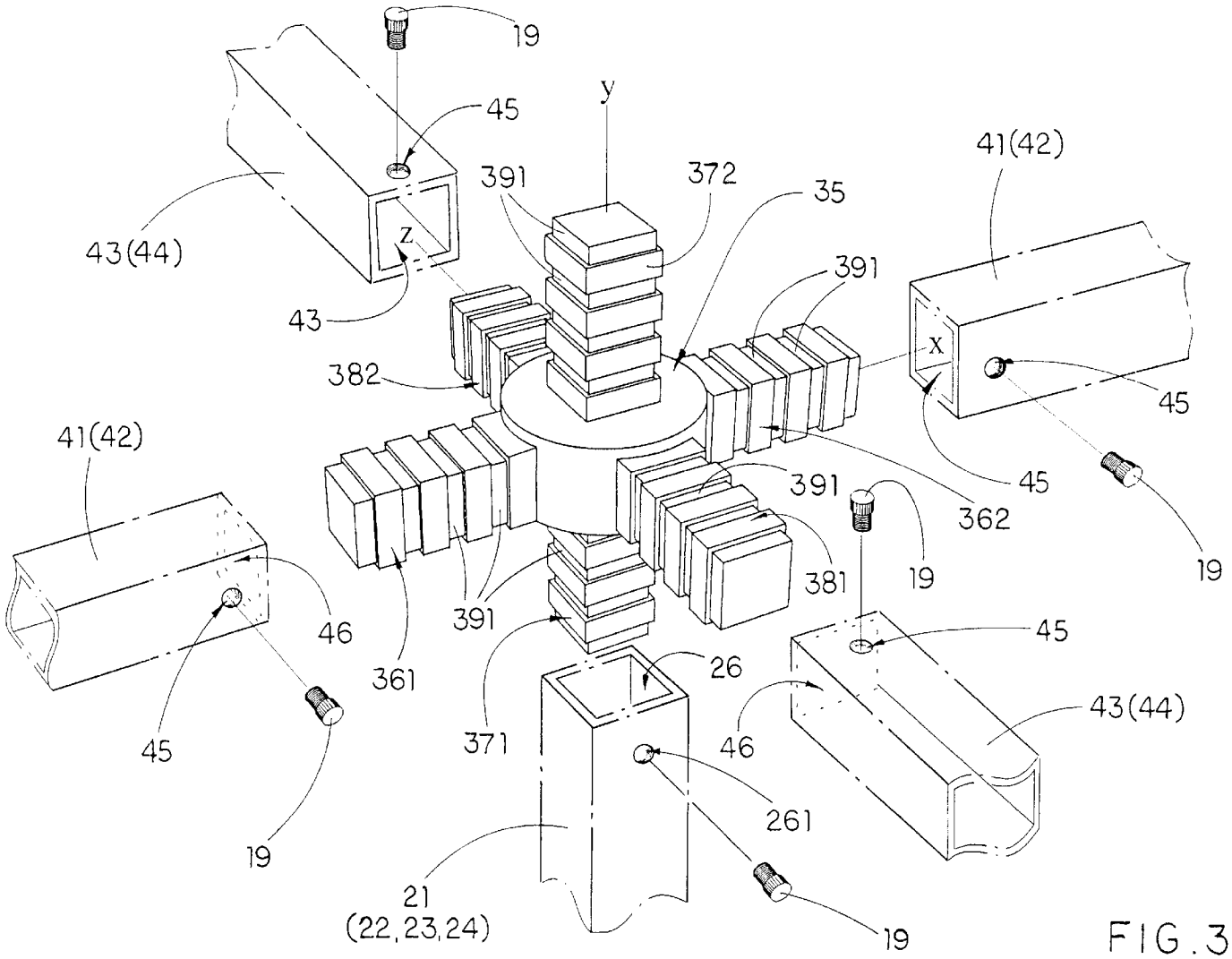
FIG. 3 is a perspective view of the triaxial construction joint of the patio construction according to the above preferred embodiment of the present invention.
Figure 5:
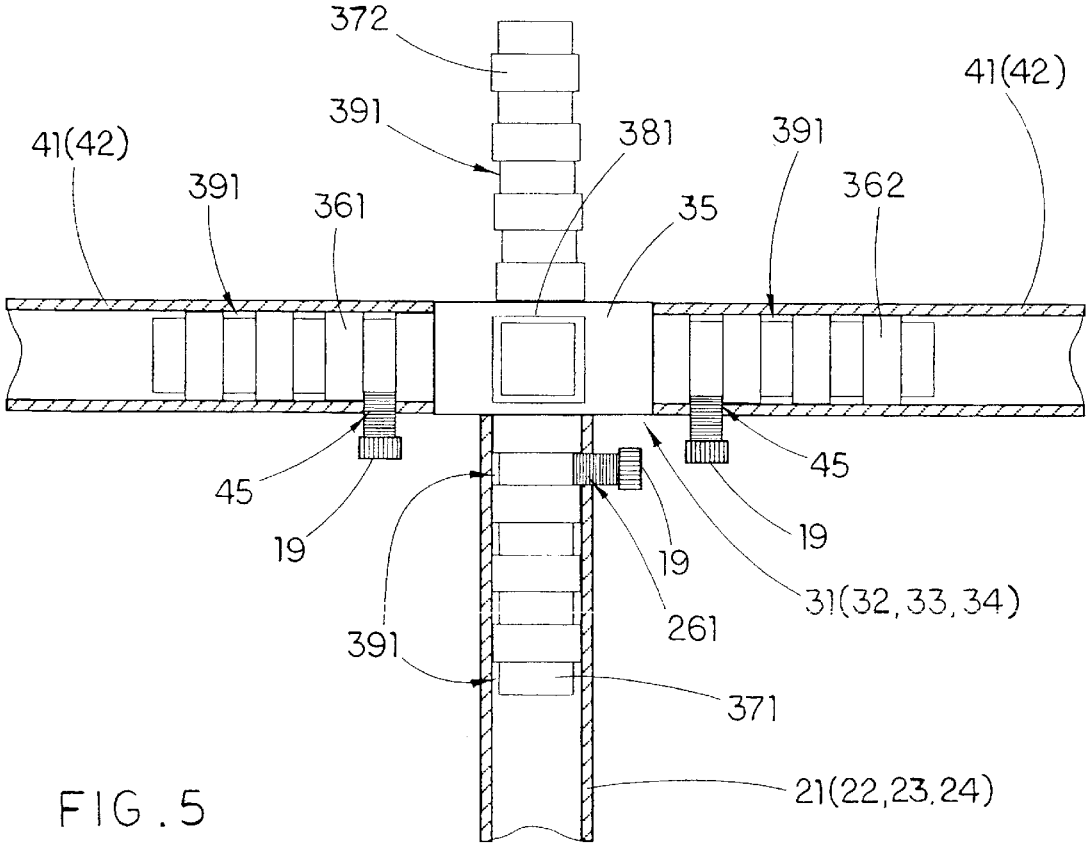
FIG. 5 is a sectional view of the triaxial construction joint of the patio construction according to the above preferred embodiment of the present invention, illustrating the connection between the triaxial construction joint and the horizontal construction beams and the vertical construction beam.

As shown in FIGS. 1, 3 and 5, each of the triaxial construction joints 31, 32, 33, 34 comprises a circular central joint body 35, a left and a right connecting post 361, 362 integrally extending form the joint body 35 and along a x-axis of the triaxial construction joint 31, 32, 33, 34, a bottom and a top connecting joint 371, 372 integrally extending from the joint body 35 and along a y-axial of the triaxial construction joint 31, 32, 33, 34, and a front and a rear connecting post 381, 382 integrally extending from the joint body 35 and along z-axis of the triaxial construction joint 31, 32, 33, 34. The triaxial construction joints 31, 32, 33, 34 can be made of aluminum or ABS plastic. Each of the connecting posts 361, 362, 371, 372, 381, 382 also has a predetermined length and a predetermined number of locking grooves 391 provided therearound in equally spaced manner. The size of the bottom connecting post 371 of each construction joint 31, 32, 33, 34 is preferred equal to the size of the top connecting end sockets 26 of the four vertical construction beams 21, 22, 23, 24.

Figure 4:
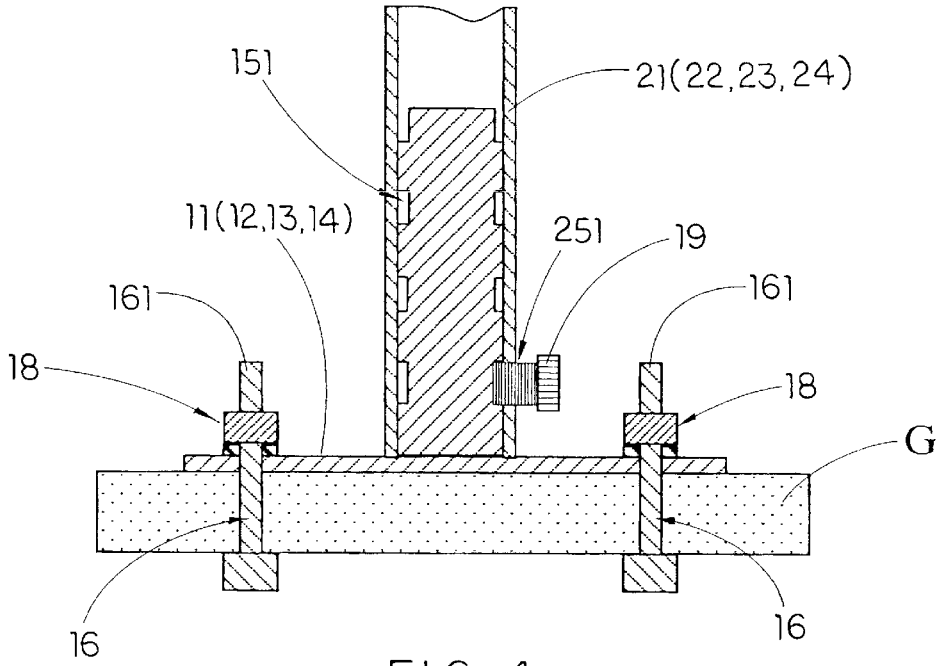
FIG. 4 is a sectional view of the base joint of the patio construction according to the above preferred embodiment of the present invention, illustrating the connection between the base joint and the bottom connecting end socket of the vertical construction beam.

As shown in FIGS. 3 and 4, the four bottom connecting posts 371 of the four triaxial construction joints 31, 32, 33, 34 are fittedly inserted into the four top connecting end sockets 26 of the four vertical construction beams 21, 22, 23, 24 respectively, so as to firmly support the four triaxial construction joints 31, 32, 33, 34 on top of the four vertical construction beams 21, 22, 23, 24 respectively. Similarly, in order to lock the four triaxial construction joints 31, 32, 33, 34 in position, four more locking screws 19 are respectively screwed into the four top locking screw holes 261 of the four vertical construction beams 21, 22, 23, 24 until each of the locking screws 19 is selectively engaged in one of the locking grooves 391 of the respective bottom connecting post 371 of the respective triaxial construction joint 31, 32, 33, 34.

As shown in FIGS. 1, 3 and 5, each of the horizontal construction beams 41, 42, 43, 44 is made of aluminum (or ABS plastic) square or rectangular tube having a first connecting end socket 45 and a second connecting end socket 46, each having a size preferably equal to the size of each of the connecting posts 361, 362, 371, 372, 381, 382 of the four triaxial construction joints 31, 32, 33, 34. The two right connecting posts 362 of the first and second triaxial construction joints 31, 32 are fittedly inserted into the two first connecting end sockets 45 of the first and second horizontal construction beams 41, 42 respectively while the two left connecting posts 361 of the third and fourth triaxial construction joints 33, 34 are fittedly inserted into the two second connecting end sockets 46 of the first and second horizontal construction beams 41, 42 respectively. Moreover, the two rear connecting posts 382 of the first and third triaxial construction joints 31, 33 are fittedly inserted into the two first connecting end sockets 45 of the third and fourth horizontal construction beams 43, 44 respectively while the two front connecting posts 381 of the second and fourth triaxial construction joints 32, 34 are fittedly inserted into the two second connecting end sockets 46 of the third and fourth horizontal construction beams 43, 44 respectively. Therefore, the four horizontal construction beams 41, 42, 43, 44 are firmly supported and horizontally extended between the four vertical construction beams 21, 22, 23, 24, as shown in FIG. 1.

Similarly, in order to prevent the four horizontal construction beams 41, 42, 43, 44 from being detached accidentally, two ends of each of the four horizontal construction beams 41, 42, 43, 44 each provides at least a locking screw hole 45, so that by screwing a locking screw 19 into the respectively locking screw hole 45 until the locking screw 19 is selectively engaged in one of the locking groove 391 of the respective connecting post 361, 362, 371, 372, 381, 382 of the corresponding triaxial construction joint 31, 32, 33, 34, all the horizontal construction beam 41, 42, 43, 44 can be locked in position, as shown in FIG. 5.

Figure 6:
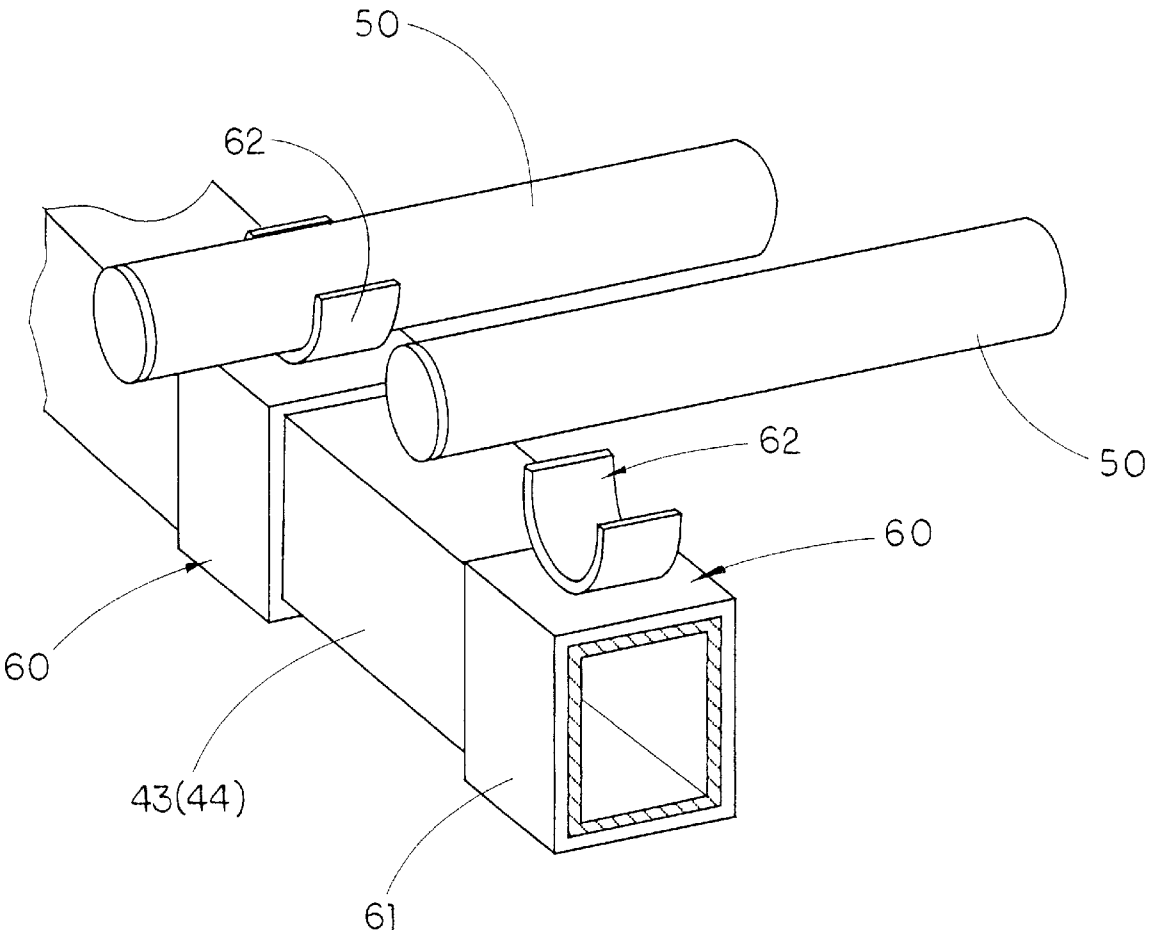
FIG. 6 is a perspective view illustrating how the ceiling bar mounted on the vertical construction beam by a mounting member according to the above preferred embodiment of the present invention.

As shown in FIG. 6, the plurality of ceiling bars 50 are mounted on and extended between at least two of the four horizontal construction beams 41, 42, 43, 44 by means of a plurality of mounting members 60. Each of the mounting members 60 comprises a holding ring 61 and a C-clip mounter 62 integrally connected on the holding ring 61 with its opening end facing upwards. The holding ring 61 also has a square or rectangular shaped adapted to fittedly slide on the respective horizontal construction beams 43, 44. One end of the respective ceiling bar 50 is clipped on the mounter 62 so as to mount on the horizontal construction beams 43, 44. As shown in FIG. 1, the user may mount a predetermined number of mounting members 60 on each of the two horizontal construction beams 43, 44 before the two horizontal construction beams 43, 44 are respectively installed between the respective triaxial construction joints 31, 32, 33, 34. Therefore, the user may simply clip on the same number of ceiling bars 50 between the two horizontal construction beams 43, 44 so as to parallelly mount the ceiling bar 50 in position. In other words, the user may feel free to add or reduce the number of the ceiling bars 50 for adjusting his or her preferred shading condition.

Figure 7:
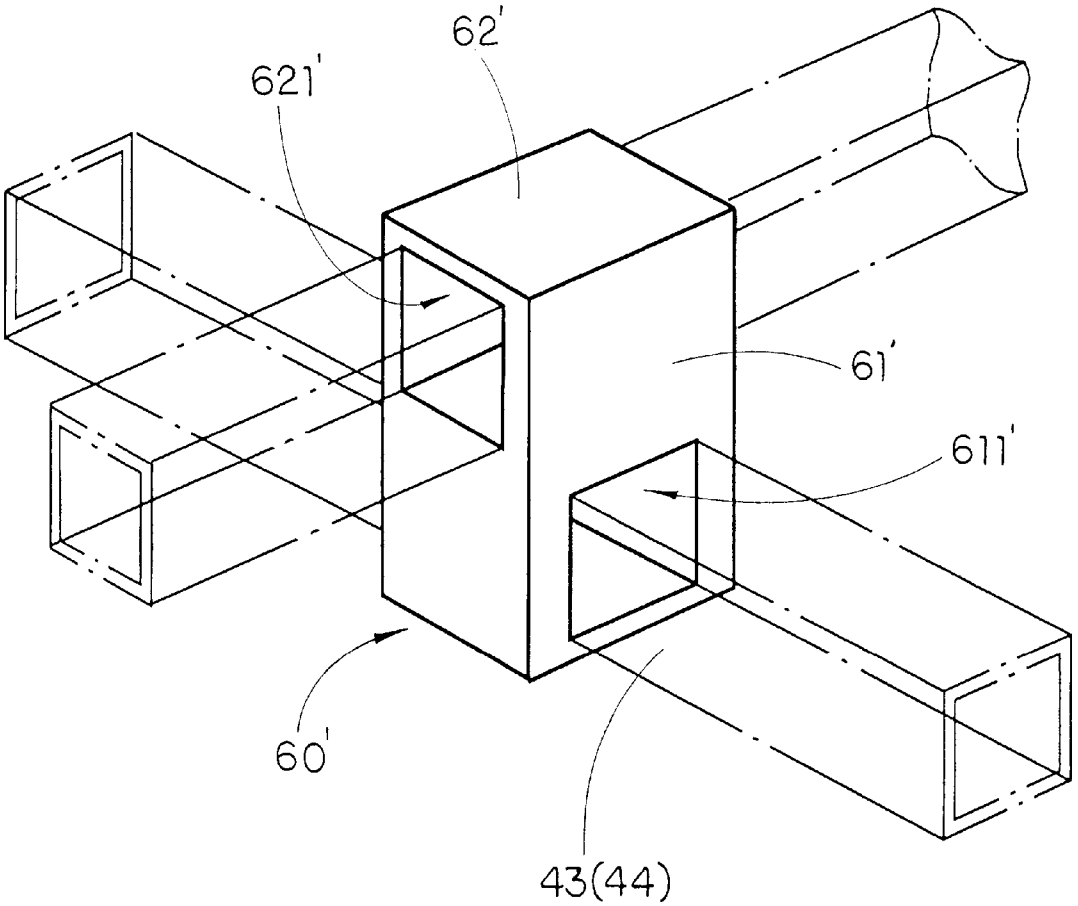
FIG. 7 is a perspective view illustrating an alternative mode of the mounting member according to the above member according to the above preferred embodiment of the present invention.

As shown in FIG. 7, an alternative mode of the mounting member 60' is illustrated. The alternative mounting member 60' also comprises a holding ring 61' for slidably mounting on the respective horizontal construction beam 43, 44. However, a second holding ring 62' substitute the C-clip 62 acting as the mounter, wherein the axial hole 621' of the mounter 62' is perpendicular to the axial hole 611' of the holding ring 61', so that the ceiling bar 50 can be mounted between the two horizontal construction beams 43, 44 by sliding the two ends of the respective ceiling bar 50 through the axial holes 621' of the respective mounting members 60' mounted on the two horizontal construction beams 43, 44 respectively. By means of the mounting member 60 or 60', the installation and disassembly of the ceiling bars 50 are fast and easy. The user can adjust the number and position of the ceiling bars 50 any time.

As shown in FIG. 1, additional base joints 13', 14', vertical construction beams 23', 24', triaxial construction joints 33', 34', horizontal construction beams 41', 42', 44' and ceiling bars 50' can be additionally connected to the basic patio construction described above for extending the size of the patio to any desired dimension. Besides, all the top connecting posts 372 of the triaxial construction joints 31, 32, 33, 34 are extending upwards, so that the user may take advantage of that to hang on plants or other objects. If the user would like to place a shading cloth on top of the patio construction, the shading cloth may tight or fasten to those top connecting posts 372 too.

Figure 8:
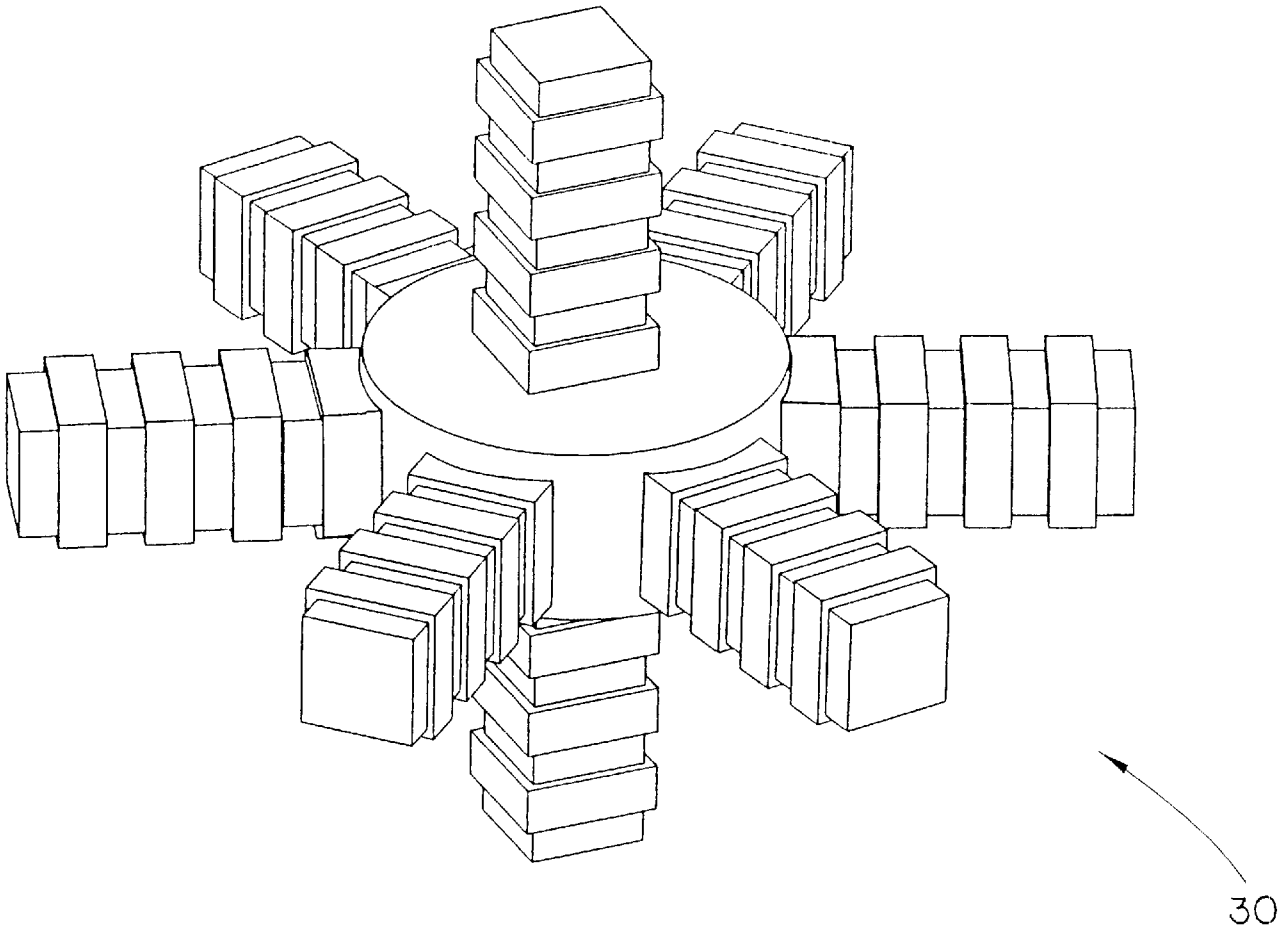
FIG. 8 is a perspective view of an alternative mode of the construction joint according to the above preferred embodiment of the present invention.

FIG. 8 illustrates an alternative triaxial construction joint 30 which comprises additional connecting posts extended in various angles so as to enable the patio to construct in other geometrical shape.

In view of above, the patio construction utilizes standard components to enable the house owner to easily assemble or disassemble the patio without the need of any specific tool or construction skill. It not only minimizes the building cost and simplifies the components thereof, but also provides a firm and rigid structure. Accordingly, the user can disassemble the patio when he or she moves out the old house and reassemble the patio at the new house.

What is claimed is:

1. A patio construction, comprising:

at least a first, a second, a third, and a fourth base joint, wherein each of said base joints is adapted to be spacedly affixed on ground and has a supporting post extended upwardly and vertically;

at least a first, a second, a third, and a fourth vertical construction beam, wherein each of said construction beams has a top connecting end socket and a bottom connecting end socket, said four supporting posts of said four base joints are fittedly inserted into said four bottom connecting end sockets of said four vertical construction beams respectively, so as to support said four vertical construction beams to firmly extend upwardly and vertically;

at least a first, a second, a third, and a fourth triaxial construction joint, wherein each of said triaxial construction joints comprises a central joint body, a left and a right connecting post extending from said joint body and along a x-axis of said triaxial construction joint, a bottom connecting joint extending from said joint body and along a y-axial of said triaxial construction joint, and a front and a rear connecting post extending from said joint body and along a z-axis of said triaxial construction joint, wherein said four bottom connecting posts of said four triaxial construction joints are fittedly inserted into said four top connecting end sockets of said four vertical construction beams respectively, so as to firmly support said four triaxial construction joints on top of said four vertical construction beams respectively;

at least a first, a second, a third, and a fourth horizontal construction beams, each of said horizontal construction beams having a first connecting end socket and a second connecting end socket, wherein said two right connecting posts of said first and second triaxial construction joints are fittedly inserted into said two first connecting end sockets of said first and second horizontal construction beams respectively while said two left connecting posts of said third and fourth triaxial construction joints are fittedly inserted into said two second connecting end sockets of said first and second horizontal construction beams respectively, wherein said two rear connecting posts of said first and third triaxial construction joints are fittedly inserted into said two first connecting end sockets of said third and fourth horizontal construction beams respectively while said two front connecting posts of said second and fourth triaxial construction joints are fittedly inserted into said two second connecting end sockets of said third and fourth horizontal construction beams respectively, so as to enable said four horizontal construction beams being firmly supported and horizontally extended between said four vertical construction beams;

a plurality of ceiling bars mounted on and extended between at least two of said four horizontal construction beams; and a plurality of mounting members respectively mounting said plurality of ceiling bars on and extended between at least two of said four horizontal construction beams, wherein each of said mounting members comprises a first holding ring fittedly sliding on said two facing respective horizontal construction beams and a mounter for mounting a respective end of said respective ceiling bar in position, wherein each of said mounters is a C-clip mounter integrally connected on said respective holding ring with an opening end thereof facing upwards, said end of said respective ceiling bar being clipped on said C-clip mounter.

2. A patio construction, comprising:

at least a first, a second, a third, and a fourth base joint, wherein each of said base joints is adapted to be spacedly affixed on ground and has a supporting post extended upwardly and vertically;

at least a first, a second, a third, and a fourth vertical construction beam, wherein each of said construction beams has a top connecting end socket and a bottom connecting end socket, said four supporting posts of said four base joints are fittedly inserted into said four bottom connecting end sockets of said four vertical construction beams respectively, so as to support said four vertical construction beams to firmly extend upwardly and vertically, wherein a top end of each of said vertical construction beams provides at least a top locking screw hole;

at least a first, a second, a third, and a fourth triaxial construction joint, wherein each of said triaxial construction joints comprises a central joint body, a left and a right connecting post extending from said joint body and along a x-axis of said triaxial construction joint, a bottom connecting joint extending from said joint body and along a y-axial of said triaxial construction joint, and a front and a rear connecting post extending from said joint body and along a z-axis of said triaxial construction joint, wherein said four bottom connecting posts of said four triaxial construction joints are fittedly inserted into said four top connecting end sockets of said four vertical construction beams respectively, so as to firmly support said four triaxial construction joints on top of said four vertical construction beams respectively, wherein each of said left, right, front, rear, and bottom connecting posts has a predetermined length and a predetermined number of locking grooves provided therearound;

at least a first, a second, a third, and a fourth horizontal construction beams, each of said horizontal construction beams having a first connecting end socket and a second connecting end socket, wherein said two right connecting posts of said first and second triaxial construction joints are fittedly inserted into said two first connecting end sockets of said first and second horizontal construction beams respectively while said two left connecting posts of said third and fourth triaxial construction joints are fittedly inserted into said two second connecting end sockets of said first and second horizontal construction beams respectively, wherein said two rear connecting posts of said first and third triaxial construction joints are fittedly inserted into said two first connecting end sockets of said third and fourth horizontal construction beams respectively while said two front connecting posts of said second and fourth triaxial construction joints are fittedly inserted into said two second connecting end sockets of said third and fourth horizontal construction beams respectively, so as to enable said four horizontal construction beams being firmly supported and horizontally extended between said four vertical construction beams; wherein two ends of each of said horizontal construction beams each provides at least a locking screw hole;

a plurality of locking screws, wherein four of said locking screws are respectively screwed into said four top locking screw holes of said four vertical construction beams until each of said locking screws is selectively engaged in one of said locking grooves of said respective bottom connecting post of said respective triaxial construction joint, and that said other locking screws are used to respectively screw into said locking screw holes positioned at said two ends of said four horizontal construction beams until each of said locking screws is selectively engaged in one of said locking groove of said respective connecting post of said corresponding triaxial construction joint; and a plurality of mounting members respectively mounting said plurality of ceiling bars on and extended between at least two of said four horizontal construction beams, wherein each of said mounting members comprises a first holding ring fittedly sliding on said two facing respective horizontal construction beams and a mounter for mounting a respective end of said respective ceiling bar in position, wherein each of said mounters is a C-clip mounter integrally connected on said respective holding ring with an opening end thereof facing upwards, said end of said respective ceiling bar being clipped on said C-clip mounter.

3. A patio construction, as recited in claim 2, wherein along said supporting post of each of said base joints, a predetermined number of locking grooves are spacedly provided around said supporting post.

4. A patio construction, as recited in claim 3, wherein at least a bottom locking screw hole is formed on bottom end of each of said vertical construction beams respectively, said patio construction further comprising four more locking screws which are respectively screwed into said four bottom locking screw holes of said four vertical construction beams until each of said four locking screws is selectively engaged in one of said locking groove of said respective supporting post of said respective base joint.

* * * * *